US005947706A

United States Patent [19]

Gapinski

[11] Patent Number: 5,947,706

[45] **Date of Patent: *Sep. 7, 1999**

[54] HAND OPERATED FLOOR PUMP WITH RETRACTABLE STAND

[75] Inventor: Albert G. Gapinski, Boulder, Colo.

[73] Assignee: Schwinn Cycling & Fitness Inc., a Delaware corporation, Boulder, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/635,776

[22] Filed: Apr. 22, 1996

[51] Int. Cl.[6] ..... F04B 39/10

[52] U.S. Cl. ..... 417/437; 248/125.1; 248/188.7

[58] Field of Search ..... 417/437, 374, 417/545, 550–554, 555.1, 569, 512; 248/125.1, 163.1, 165, 188.7

[56] References Cited

U.S. PATENT DOCUMENTS

| | | | |
|---|---|---|---|
| 898,263 | 9/1908 | Rice | 248/125.1 |
| 1,613,338 | 1/1927 | Wepplo | 417/555.1 |
| 1,737,534 | 11/1929 | Davis | 417/555.1 |
| 1,975,303 | 10/1934 | Walker et al. | 248/125.1 |
| 4,111,095 | 9/1978 | Simons | 248/125.1 |
| 5,161,768 | 11/1992 | Sarabin | 248/125.1 |
| 5,551,848 | 9/1996 | Chuang et al. | 417/437 |

OTHER PUBLICATIONS

Zefal Pump for Scrhaeder/Presta valve, source unknown, at least as early as Apr. 22, 1996.

Topeak Pump Advertisement, "Products," *American Bicyclist,* Jun. 1996, p. 29.

Ultimate Bicycle Support Product Catalog (1994), Ultimate®, 2506 Zurich Drive, P.O. Box 470, Fort Collins, Colorado 80522–04700.

Blackburn Floor Pumps Brochure, at least as early as Apr. 22, 1996, pp. 6–9.

TaTa Industial Co., Ltd. Catalog, Premier Power Products, Inc., P.O. Box 3506, Ontario, CA 91761, pp. 5–8, at least as early as Apr. 22, 1996.

Coido Rust–Free Plastic Hand Pump Brochure, Taiwan, at least as early as Apr. 22, 1996.

Minipumps, Kompressoren Catalog 94/95, SKS Germany, Postfach 1409 59844 Sundern, p. 12–19 Jan. 1994.

Barbieri Air Manometer Digital Pump Brochure, Barbieri SNC, Bologna, Italy, Nov. 20, 1995.

RapiSeal Leak Proof Connection Brochure, Barbieri SNC, Bologna, Italy, Nov. 20, 1995.

Silca SRL brochure, 20096 Pioltello, Italy, at least as early as Apr. 22, 1996.

Topeak Bicycle Accessories 1995/1996 Season Catalog, Todson Inc., 14 Connor Lane, Deer Park, NY 11729–7210, pp. 5–7.

Vetta VP–30 floor Pump brochure, Vetta Sports Inc. 1500 Kearns Blvd., Park City, UT 84060, at least as early as Apr. 22, 1996, pp. 1–2.

*Primary Examiner*—Charles G. Freay

*Attorney, Agent, or Firm*—Holland & Hart LLP

[57] ABSTRACT

A hand operated floor pump has a retractable stand of a tripod type which is movable between a retracted position wherein three support legs are held in closely adjacent relationship with a pump barrel and an expanded position wherein the legs extend substantially radially from the pump barrel to provide stable support for the pump.

20 Claims, 5 Drawing Sheets

HAND OPERATED FLOOR PUMP WITH RETRACTABLE STAND

BACKGROUND OF THE INVENTION

1. Field of the Invention

The present invention relates generally to floor pumps and more particularly to a hand operated floor pump with a retractable stand.

2. Description of the Known Art

Hand pumps have existed for many years for purposes of manual operation in the inflation of various items. Typically such items are recreational products, but hand pumps have also been used for other purposes such as on tires for automotive vehicles. More commonly, however, hand pumps are used to inflate the tires of bicycles, pneumatic balls and other such recreational items.

Some hand pumps are relatively small and are adapted to be held in one hand and operated with another by reciprocally moving, telescoping or axially aligned components to compress air within a cylinder which is transferred from the cylinder into a valve stem or sealed hole in the article being inflated. Hand operated floor pumps are also well known in the art and typically are larger than the hand held pumps. The hand operated floor pumps are adapted to be placed on a supporting surface and usually held in place with the operator's foot which engages an anchor or pedal on the lower end of the pump.

Hand operated floor pumps typically include an elongated cylindrical barrel having a piston rod with a handle at one end so that the piston rod can be reciprocated relative to the barrel to compress air on alternating strokes. The compressed air is forced out of an opening in the barrel, which is typically in communication with a flexible hose having a valve head on its terminal end. Valve heads take numerous forms, but are adapted to be connected to valve stems or needles for insertion into sealed openings in pneumatic balls or the like so that the compressed air can be transferred into the article being inflated.

One problem with hand operated floor pumps is that they are not satisfactorily self supporting and will not therefore stand vertically erect for convenient operation without the assistance of an operator. Accordingly, the operator's foot must necessarily be held on an anchor or foot pedal intended to hold the barrel of the pump in an upright operating position. Many times, however, the foot anchors or pedals are not rigid with respect to the barrel thereby allowing the barrel to move independently of the foot pedal. Further, the necessity of the operator to keep his foot on the anchor or pedal restricts the freedom of the operator since his foot by necessity is located closely adjacent to the pump barrel.

It is to overcome the above shortcomings in hand operated foot pumps that the present invention has been developed.

SUMMARY OF THE INVENTION

The present invention concerns a hand operated foot pump having a retractable stand allowing the pump to remain erect without assistance from an operator.

In the preferred embodiment of the stand, it is of the tripod type having three pivotally-mounted legs which are movable between extended and retracted positions. In the retracted position, the legs extend in closely adjacent parallel relationship with the barrel of the pump, while in the extended position, the legs project substantially radially away from the barrel to provide a dependable support base for the barrel of the pump.

A first end of each support leg is pivotally connected to a slidable collar mounted on the pump barrel with an intermediate location of each leg pivotally receiving one end of a link arm whose opposite end is pivotally anchored to the pump barrel beneath the collar. Sliding movement of the collar longitudinally of the barrel effects movement of the legs between the retracted and extended positions.

The collar is an elongated sleeve having a longitudinal slot formed adjacent to the top edge of the sleeve with a pair of spaced ears projecting radially from either side of the slot. The spaced ears are interconnected by a connector pin which receives a cam arm on one end so that operative compressive engagement of the cam arm with one of the ears reduces the width of the slot as well as the diameter of the collar allowing the collar to selectively fictionally grip the barrel. In this manner, when the collar is elevated, moving the support legs into the retracted position, the collar can be clamped in place to retain the legs in the retracted position for storage purposes. To move the legs to the extended position, the clamp is simply released allowing the collar to slide downwardly while the legs pivot outwardly. A tubular stop is also provided beneath the collar on the pump barrel to limit downward movement of the collar, thereby desirably positioning the legs in the extended supporting position when the collar engages the tubular stop.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
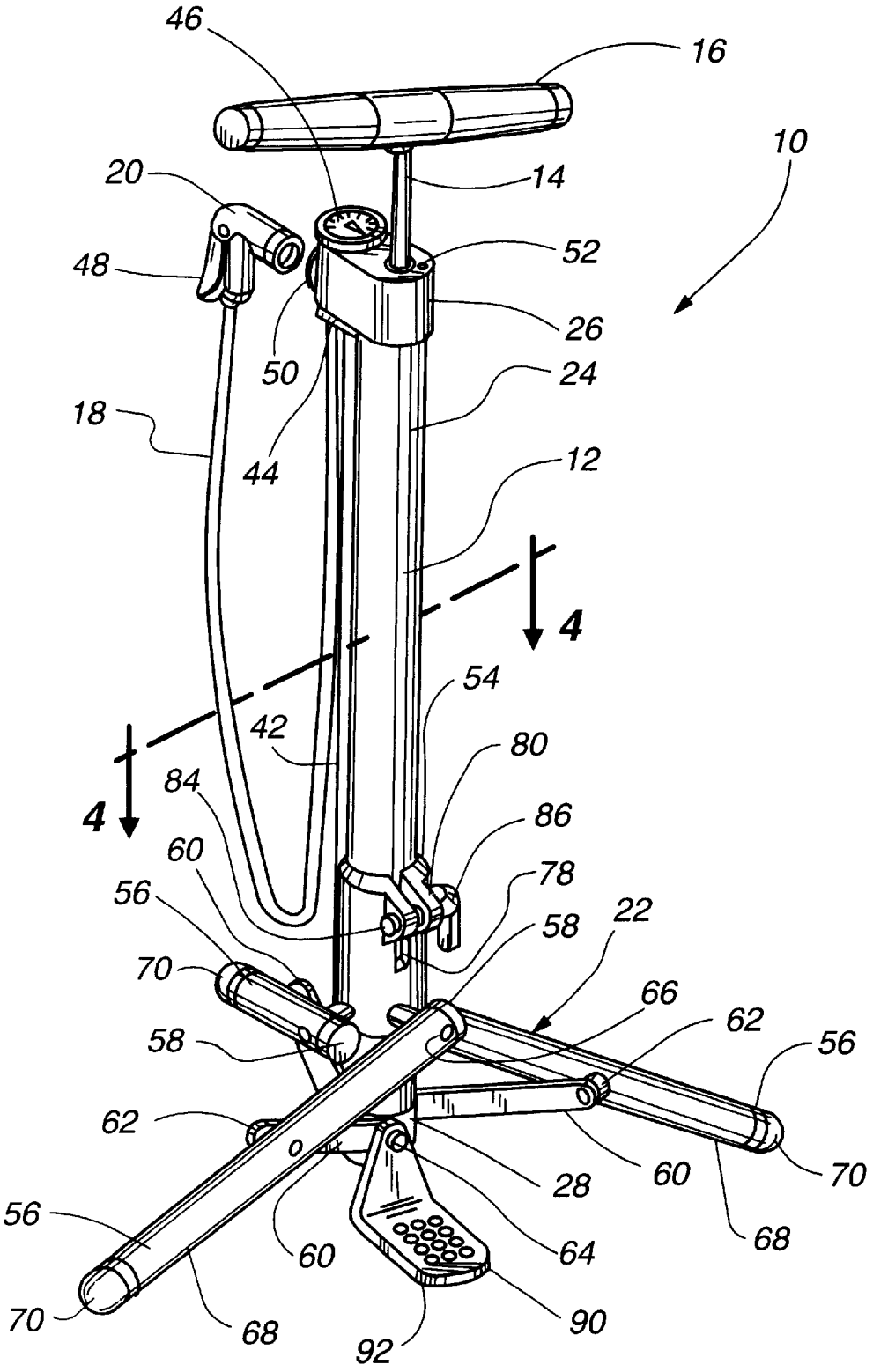
FIG. 1 is an isometric view of the floor pump of the present invention with the collapsible stand in an extended supporting position.
Figure 2:
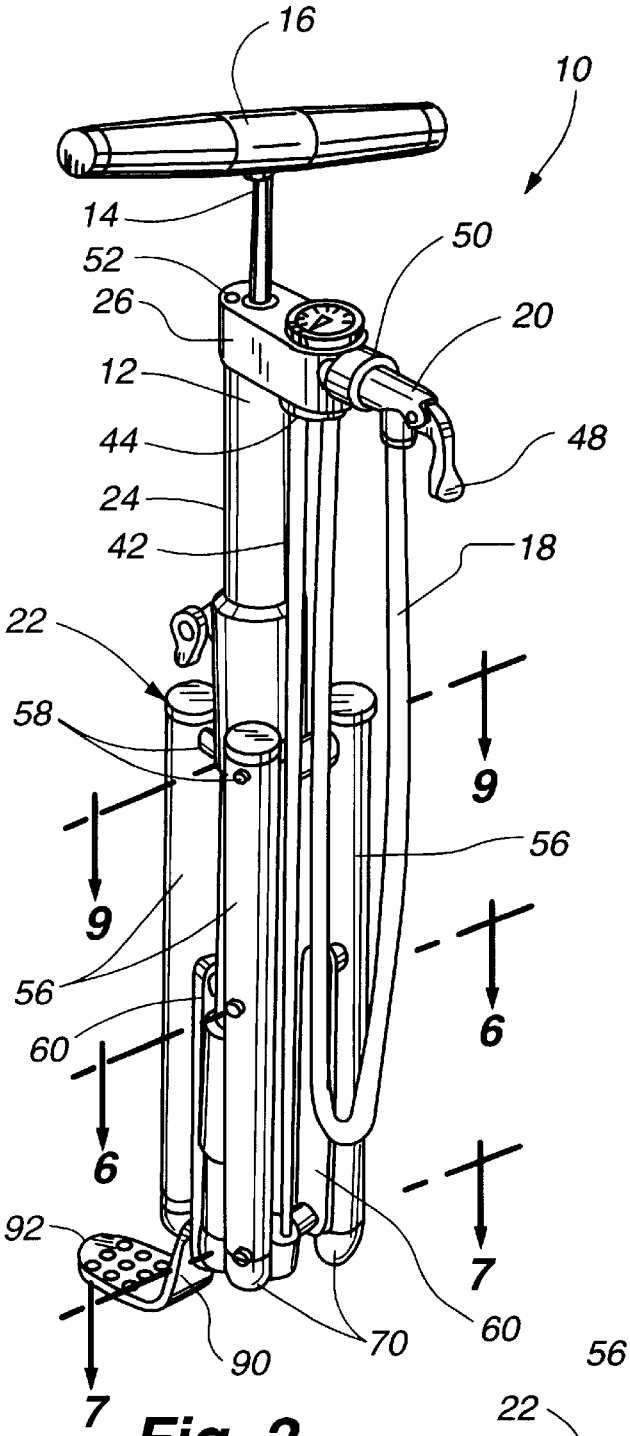
FIG. 2 is an isometric view similar to FIG. 1 with the collapsible stand in a retracted non-supporting position.

The floor pump 10 of the present invention includes a hollow pump barrel 12 having a piston rod 14 and a handle 16 for reciprocally moving the piston rod relative to the barrel, a flexible hose 18 for delivering compressed air to an inflatable object (not shown) and a valve head 20 for releasable connection to the inflatable article. The pump 10 further includes a retractable stand 22 mounted on a lower end of the pump barrel for movement between an extended supporting position as shown in FIG. 1. and a retracted non-supporting position as shown in FIG. 2.

Figure 6:
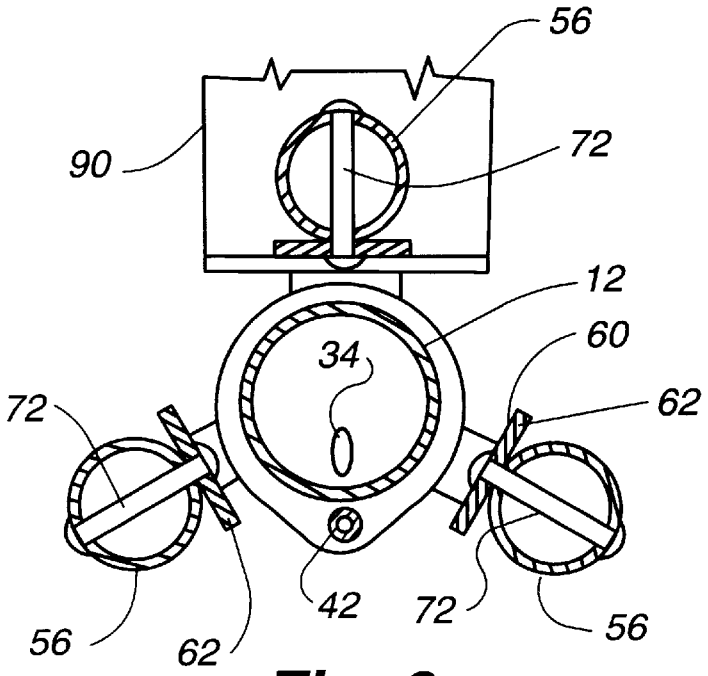
FIG. 6 is an enlarged fragmentary section taken along line 6—6 of FIG. 2.
Figure 7:
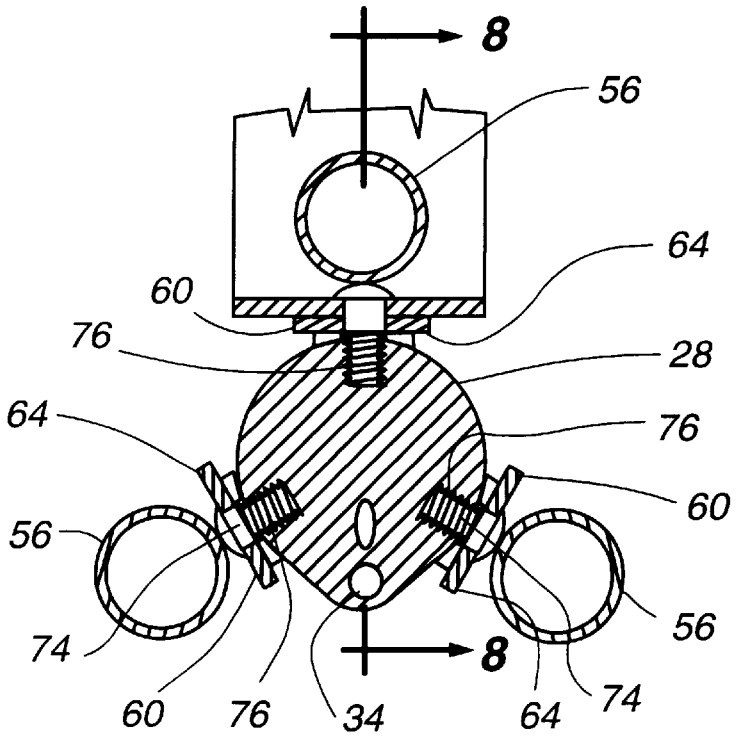
FIG. 7 is an enlarged fragmentary section taken along line 7—7 of FIG. 2.
Figure 9:
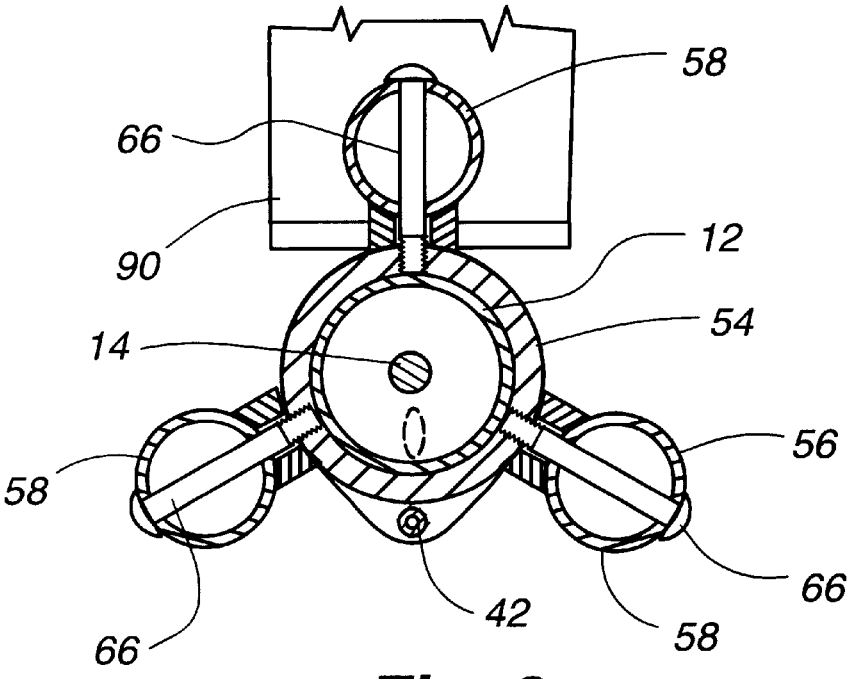
FIG. 9 is a section taken along line 9—9 of FIG. 2.
Figure 8:
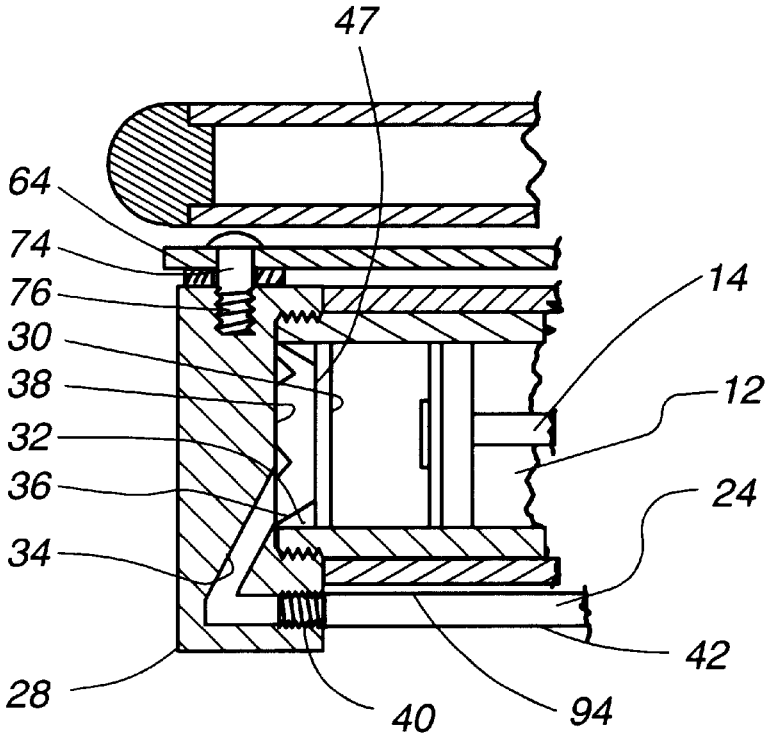
FIG. 8 is a further enlarged fragmentary section taken along line 8—8 of FIG. 7.

The pump barrel 12 includes an elongated hollow cylindrical main body 24 having an upper end cap 26 and a lower end cap 28. The lower end cap, as possibly best seen in FIGS. 6, 7 and 8, is of tear drop configuration and substantially solid construction. The top surface 30 of the lower end cap has a circular internally threaded recess 32 adapted to threadedly receive the lower end of the cylindrical main body 24. A generally V-shaped passage 34 is provided in the lower end cap between the bottom 36 of the recess and a radially displaced top surface 38 so as to establish communication between the interior of the main cylindrical body and the exterior. The lower end cap is internally threaded at the location 40 where the passage 34 opens externally of the main body and the lower end of a rigid transfer tube 42 is threadedly received in the passage. The upper end of the transfer tube is similarly threadedly received in a lower surface 44 of the upper end cap 26 so as to be in operative communication with a pressure gauge 46. A conventional check valve 47 is incorporated in the barrel 24 at the open end of the V-shaped passage 34. The check valve 47 eliminates the back-flow of air.

The upper end cap 26 is of somewhat ovular configuration so as to accommodate the piston rod 14 as well as the pressure gauge in side-by-side relationship. The flexible conduit or hose 18 is also connected at a fixed end to the upper end cap so as to be in communication with the pressure gauge and the rigid transfer tube 42. The flexible hose has the valve head 20 on a free end. The valve head can be of a conventional type having a cam operated releasable clamp 48 for securing the valve head to a conventional valve stem or valve needle so that compressed air can be delivered through the valve head to the stem or needle. A cylindrical storage receptacle 50 is provided on a lateral side of the upper end cap 26 to releasably receive and retain the valve head, as seen in FIG. 2, when it is not being used. The receptacle can have a resilient inner lining (not shown) to yieldingly grip the valve head or another type of retention system such as a leaf spring which would yieldingly retain the valve head within the receptacle.

As will be appreciated, an internal chamber (not seen) is defined by the hollow cylindrical main body 24 of the pump. The internal chamber is in communication with the passage 34 through the lower end cap 28, the rigid transfer tube 42, the flexible hose 18 and the valve head 20 so that compressed air can be transferred from the cylindrical main body to the valve head in a conventional manner. Of course, the piston rod has a piston head (not seen) on its lower end which engages the internal wall of the chamber of the main body on a depressing stroke of the piston rod but allows air to pass thereby on a retracting stroke. Air is allowed to move from the ambient environment into the cylindrical main body above the piston head on the downward compressing stroke of the piston rod through an aperture 52 in the upper end cap 26 that loosely and slidably receives the piston rod 14.

The retractable stand 22 for the pump 10 is possibly best seen in FIG. 1 to include a slide collar 54, three support legs 56 pivotally connected at a first end 58 to the slide collar and three link arms 60 associated with each support leg. The link arms have a first end 62 pivotally connected to an intermediate location on an associated support leg 56 and a second end 64 pivotally connected to the lower end cap 28 of the pump barrel.

Adjacent the lower end of the slide collar 54, three circumferentially equally spaced and radially extending pivot pins 66 are secured to the collar. The pivot pins are received in openings in the first end 58 of each support leg 56 and retained therein in any conventional manner such as by riveting. The opposite or second ends 68 of the support legs preferably have rubber caps 70 which are adapted to engage and support the pump on a support surface.

The link arms 60 are pivotally connected to the intermediate location on an associated support leg in any conventional manner, which again might be with a riveted pivot pin 72. The second end 64 of each link arm is pivotally connected to the lower end cap 28 at equally circumferentially spaced locations by threaded pivot pins 74 which are threadedly received in circumferentially spaced radially directed openings 76 provided in the periphery of the lower end cap. While the support legs 56 are tubular in construction, the link arms 60 are flat bars that extend in a parallel plane with the associated support leg to which they are connected so that each is free to pivot relative to the other and relative to the pump barrel 12 and the slide collar 54 respectively.

The slide collar 54 has a longitudinal slot 78 formed from its upper edge and a pair of radially directed ears 80 disposed on opposite sides of the slot. Each ear has an opening therethrough and a connector pin 82 extends through the openings. The connector pin has an enlarged head 84 on one end and a lever arm 86 with a cam head 88, as probably best seen in FIGS. 1 and 3, on the other end. The lever arm is pivotally mounted on the pin 82 so as to establish a quick-release lock allowing the cam head to force one ear toward the other thereby reducing the width of the slot and consequently the diameter of the collar so that the collar can frictionally grip the main cylindrical body 24 of the pump barrel 12. This allows the collar to be positively but releasably positioned at selected locations along the length of the pump barrel so as to retain the legs 56, for example, in the retracted position of claim 2. The collar is made of a somewhat rigid but deformable material, such as plastic, to provide the desired support for the legs while allowing the collar to be deformed into tight frictional engagement with the pump barrel.

As a further means of stabilizing the pump during operation, if desired, a foot anchor or pedal 90 is pivotally connected to the lower end cap 28 of the pump barrel 12 at the connection of one of the link arms 60 to the lower end cap. The lower surface 92 of the foot anchor or pedal is co-planar with the plane of the lower or second ends 68 of the support legs when the legs are in the extended supporting position of FIGS. 1 and 3.

A tubular stop 94 is tightly fit on the cylindrical main body 24 of the pump barrel 12 immediately above the lower end cap 28. The tubular stop thereby remains fixed relative to the main body and limits the downward sliding movement of the collar.

In operation, with the legs 56 initially retracted as illustrated in FIG. 2 and the collar 54 in clamping engagement with the pump barrel 12, the quick release lever arm 86 is pivoted to allow the ears 80 to naturally separate which frees the slide collar for sliding movement downwardly along the pump barrel. The collar will typically slide by gravity but if necessary manual assistance can be provided merely by gripping the collar and sliding it along the pump barrel forcing the legs to simultaneously extend. The collar slides along the pump barrel until the lower edge of the collar engages the upper surface of the tubular stop 94 which has been pre-sized such that the disposition of the lower or second ends 68 of the support legs are co-planer with the foot pedal 90 when the collar is resting upon the top edge of the tubular stop.

Figure 3:
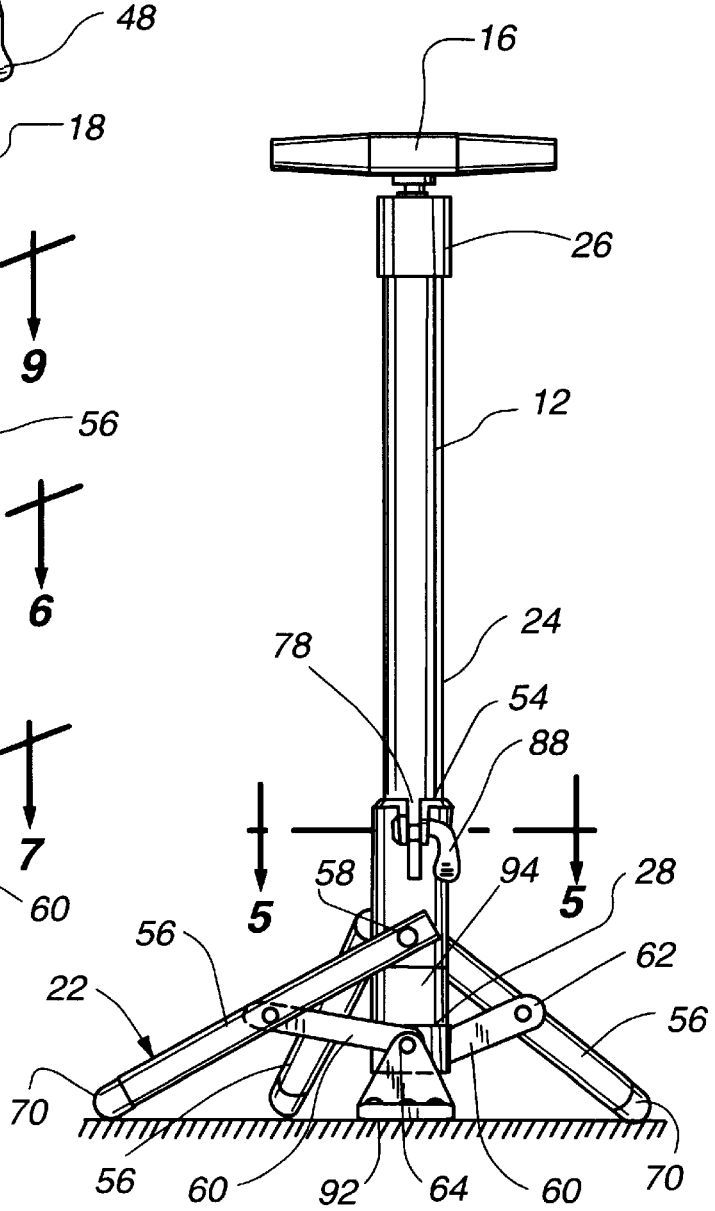
FIG. 3 is a side elevation of the pump as shown in FIG. 1.
Figure 4:
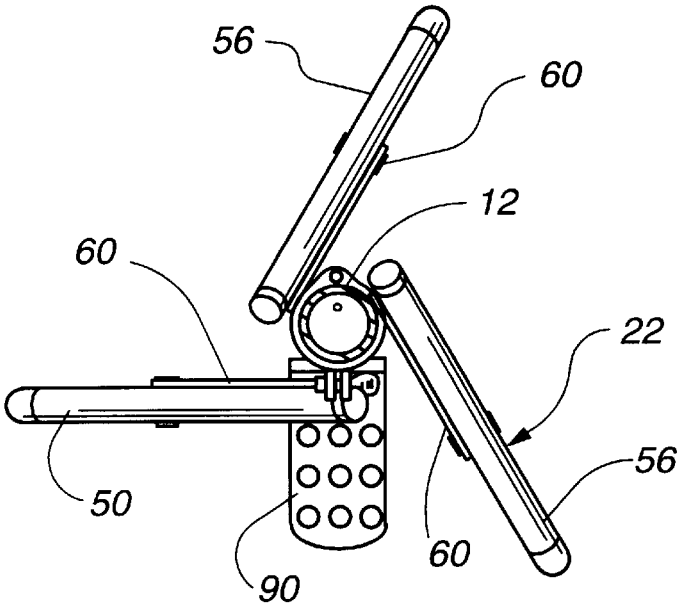
FIG. 4 is a section taken along line 4—4 of FIG. 1.
Figure 5:
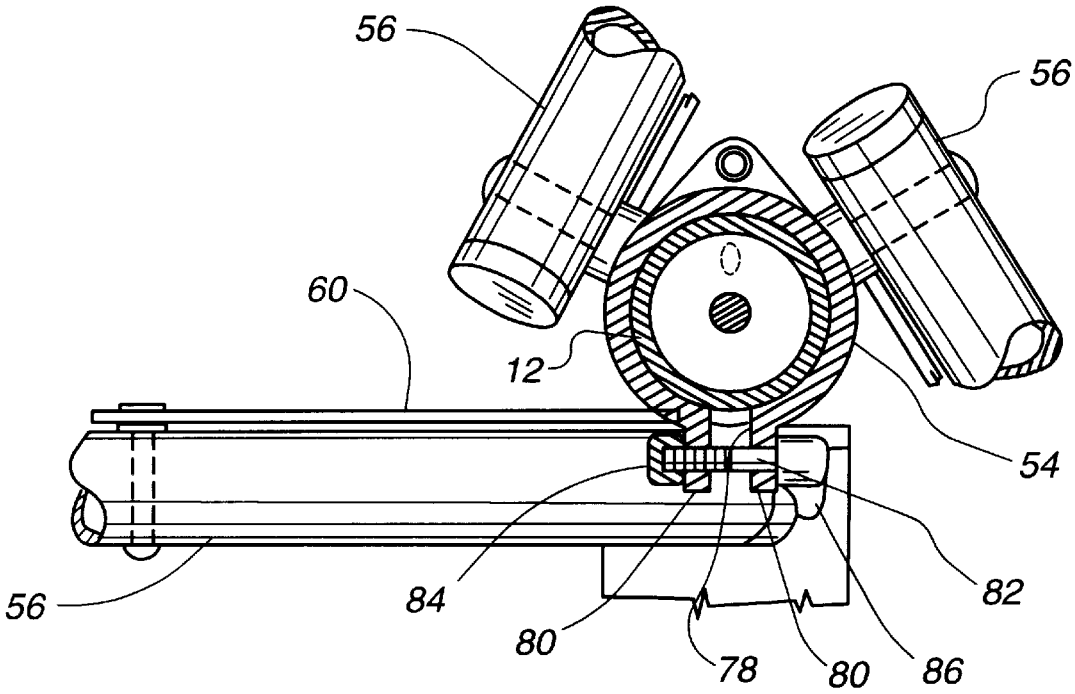
FIG. 5 is an enlarged fragmentary section taken along line 5—5 of FIG. 3.

With the legs 56 in the extended supporting position of FIGS. 1 and 3, the collar can optionally be tightened onto the pump barrel by moving the cam lever arm 86, but the collar will remain in position merely from the weight of the pump as the weight forces the lower second ends 68 of the support legs 56 upwardly thereby pulling the first upper ends 58 of the legs downwardly along with the collar to hold it in position.

To retract the legs, the cam lever arm 86 is released, if necessary, to allow the collar to be manually advanced upwardly until the legs 56 lie in closely adjacent parallel relationship with the pump barrel 12 as shown in FIG. 2. In this position, the cam lever arm is pivoted to compress the collar against the pump barrel thereby retaining the collar and the support legs in the retracted position.

It will be appreciated from the aforenoted description that a very simple but stable floor pump 10 has been described having a retractable stand 22 that is easily moveable between extended and retracted positions in an efficient manner. In the retracted position, the pump is very compact for easy convenient storage while in the extended position it is very stable for use when inflating inflatable objects.

Although the present invention has been described with a certain degree of particularity, it is understood that the present disclosure has been made by way of example, and changes in detail or structure may be made without departing from the spirit of the invention as defined in the appendix claims.

I claim:

1. A floor pump comprising:

an elongated pump barrel defining an elongated hollow chamber;

a piston slidably movable within said chamber to compress air within the chamber;

a piston rod connected to said piston with a handle for operatively and reciprocally sliding said piston longitudinally of said chamber;

an external conduit in fluid communication with said chamber;

a valve head connected in fluid communication with said conduit and adapted to be releasably connected in fluid communication with an inflatable object to transfer compressed air from said chamber to the inflatable object; and a retractable stand operatively connected to said barrel for supporting said barrel in a substantially upright position, said stand including a collar slidably mounted on said pump barrel, at least three legs pivotally connected to said collar, a link each arm pivotally connected to each of said legs and to said pump barrel such that reciprocal sliding movement of said collar along said pump barrel causes said legs to move between an extended supporting position and a retracted non-supporting position; said retractable stand selectively positionable along said pump barrel.

2. The floor pump of claim 1 wherein said stand is a tripod.

3. The floor pump of claim 1 further comprising a clamp system for releasably securing said collar to said pump barrel at selected locations along the length of said pump barrel.

4. The floor pump of claim 3 wherein said clamp system is a quick release system.

5. The floor pump of claim 3 wherein said collar is an elongated cylinder and said clamp system comprises a longitudinal slot formed in said elongated cylinder at one end, said cylinder being formed from a deformable but somewhat rigid material, and a clamping member operatively connected to said elongated cylinder adapted to reduce the width of said slot and thereby reduce the diameter of the collar allowing the collar to frictionally grip said pump barrel.

6. The floor pump of claim 5 wherein said clamping member is a lever arm with a cam surface and said elongated cylinder has a pair of separated ears adjacent to said slot, said lever arm being operatively connected to said ears to selectively allow said ears to be moved toward and away from each other.

7. The floor pump of claim 1 further comprising a stop operatively connected to said pump barrel to limit sliding movement of said collar.

8. The floor pump of claim 7 wherein said stop is a sleeve fixedly positioned on said pump barrel beneath said collar.

9. The floor pump of claim 1 wherein said legs are pivotally connected to said collar at a first end and a second end is adapted to rest on a supporting surface in the extended position of the legs.

10. The floor pump of claim 9 wherein said link arms are pivotally connected at a first end to an intermediate location on an associated leg and have a second end pivotally connected to said pump barrel.

11. The floor pump of claim 10 wherein the second end of each of said legs is positioned adjacent to said pump barrel in the retracted position and is displaced from the pump barrel in the extended position.

12. The floor pump of claim 10 wherein said pump barrel includes a plurality of circumferentially spaced threaded recesses with pivot pins received in said recesses and said second ends of said link arms are pivotally mounted on said pivot pins.

13. The floor pump of claim 10 wherein said first end of said legs are pivotally connected to said collar at circumferentially spaced locations on said collar.

14. The floor pump of claim 12 wherein said pump barrel includes a lower end cap of substantially solid construction and said threaded recesses are formed in said lower end cap.

15. A floor pump comprising in combination:

an elongated pump barrel defining an elongated hollow chamber and defining a lower end;

a piston slidably movable within said chamber to compress air within the chamber;

a piston rod connected to said piston with a handle for operatively and reciprocally sliding said piston longitudinally of said chamber;

an external conduit in fluid communication with said chamber, a valve head connected in fluid communication with said conduit and adapted to be releasably connected in fluid communication with an inflatable object to transfer compressed air from said chamber to said inflatable object;

a retractable stand operatively connected to said barrel for supporting said barrel in a substantially upright position, said stand including a collar slidably mounted on said pump barrel, at least three legs, each having a top end a bottom end, pivotally connected at each of said top ends to said collar, a link arm pivotally connected to each of said legs and to said pump barrel such that reciprocal sliding movement of said collar along said pump barrel causes said legs to move between an extended supporting position wherein said bottom end of each of said legs extends away from said pump barrel and a retracted non-supporting position wherein said bottom end of each of said legs is retracted to be adjacent to said pump barrel;

a foot pedal attached to the lower end of the pump barrel and extending substantially outwardly therefrom;

a clamp system for releasably securing said collar to said pump barrel at selected locations along the length of said pump barrel;

a stop operatively connected to said pump barrel to engage and limit sliding movement of said collar when said stand is in said extended supporting position; and said bottom ends of each of said legs being co-planar with said foot pedal when said collar engages said stop.

16. The floor pump of claim 15, wherein said stop is a sleeve fixedly positioned on said pump barrel beneath said collar.

17. The floor pump of claim 16, wherein said second ends of each of said legs and said pedal extend below the bottom end of said barrel when said collar engages said stop.

18. A floor pump comprising in combination:

an elongated pump barrel having a upper end cap and a lower end cap end, and defining an elongated hollow chamber;

a piston slidably movable within said chamber to compress air within the chamber;

a piston rod connected to said piston with a handle for operatively and reciprocally sliding said piston longitudinally of said chamber;

a transfer tube having a lower end and an upper end, said lower end attached to said lower end cap and in fluid communication with said chamber, said upper end attached to said upper end cap;

an external conduit attached to said upper end cap and in fluid communication with said transfer tube;

a valve head connected in fluid communication with said conduit and adapted to be releasably connected in fluid communication with an inflatable object to transfer compressed air from said chamber to said inflatable object; and a stand including:

a collar slidably mounted on said pump barrel;

three legs, each having a top end a bottom end, each of said legs pivotally connected at each of said top ends to said collar; and a link arm pivotally connected to each of said legs and to said pump barrel such that reciprocal sliding movement of said collar along said pump barrel causes said legs to move between an extended supporting position wherein said bottom end of each of said legs extends away from said pump barrel and a retracted non-supporting position wherein said bottom end of each of said legs is retracted to be adjacent to said pump barrel.

19. The floor pump of claim 18, wherein a pressure gauge is attached to the top end cap and is in fluid communication with both the transfer tube and said conduit for sensing the pressure of the fluid therein.

20. The floor pump of claim 18, wherein said transfer tube is substantially rigid to help support the top end cap.

* * * * *